US007757658B2

(12) United States Patent
Nagata et al.

(10) Patent No.: US 7,757,658 B2
(45) Date of Patent: Jul. 20, 2010

(54) NAGATA CYCLE ROTARY ENGINE

(76) Inventors: Sumiyuki Nagata, 1410 Timberwood Dr., Findlay, OH (US) 45840; Ryan William Cobb, 1410 Timberwood Dr., Findlay, OH (US) 45840

( * ) Notice: Subject to any disclaimer, the term of this patent is extended or adjusted under 35 U.S.C. 154(b) by 312 days.

(21) Appl. No.: 11/713,991

(22) Filed: Mar. 5, 2007

(65) Prior Publication Data

US 2007/0215094 A1 Sep. 20, 2007

(51) Int. Cl.

| | |
|---|---|
| ***F02B 53/00*** | (2006.01) |
| ***F02B 57/08*** | (2006.01) |
| ***F02B 57/10*** | (2006.01) |
| ***F01C 1/00*** | (2006.01) |
| ***F04C 18/00*** | (2006.01) |
| ***F04C 2/00*** | (2006.01) |

(52) U.S. Cl. ..... 123/243; 123/242; 123/244; 123/44 R; 418/61.1; 418/248

(58) Field of Classification Search ..... 123/210, 123/242–244, 246, 44 R, 44 D; 418/61.3, 418/61.1, 248, 158, 159, 260, 266–268
See application file for complete search history.

(56) References Cited

U.S. PATENT DOCUMENTS 822,700 A * 6/1906 Steel ..... 418/61.1
1,940,384 A * 12/1933 Zoller ..... 418/177
1,974,761 A * 9/1934 Vogel ..... 123/243
2,786,421 A * 3/1957 Prendergast ..... 418/248
3,117,561 A * 1/1964 Bonavera ..... 123/242
3,141,446 A * 7/1964 Nittka ..... 123/242
3,171,391 A * 3/1965 Appleton ..... 418/248
3,286,698 A * 11/1966 Peras ..... 123/242
3,316,887 A * 5/1967 Melvin ..... 418/61.1
3,727,589 A * 4/1973 Scott ..... 418/260
3,782,867 A * 1/1974 Gerlach et al. ..... 418/177
3,809,024 A * 5/1974 Abbey ..... 123/244
3,919,980 A * 11/1975 Veatch ..... 418/61.1
4,021,160 A * 5/1977 Todorovic ..... 418/61.1
4,089,305 A * 5/1978 Gregg ..... 123/244
4,915,071 A * 4/1990 Hansen ..... 123/242
6,530,357 B1 * 3/2003 Yaroshenko ..... 123/244
6,651,609 B2 * 11/2003 Nagata et al. ..... 123/243

* cited by examiner

*Primary Examiner*—Thai Ba Trieu

(57) ABSTRACT

An internal combustion rotary engine using vanes to create separate combustion chambers within the engine and capable of performing all four strokes of the Otto cycle (intake, compression, combustion and exhaust) in each separate combustion chamber. Each Otto cycle is completed in a 180-degree rotation with all four strokes of the Otto cycle being completed in 720 degrees. An intake and exhaust valve system tightly controls the flow of the air/fuel mixture into each separate combustion chamber.

6 Claims, 10 Drawing Sheets

NAGATA CYCLE ROTARY ENGINE

Reference Japan Patent Application No. 2006-102445 filed Mar. 6, 2006

Small entity status claimed under 35 USC 41

FIELD OF THE INVENTION

This invention relates to rotary internal combustion engines, pumps and compressors.

DESCRIPTION OF THE PRIOR ART

Since its invention in the 1950's the rotary engine has not enjoyed wide-spread production or success. The first mass produced rotary engine was the Wankel Rotary Engine (1950). It was invented as an alternative to the piston engine. The main advantage of the rotary engine is its compact and efficient layout.

Since the invention of the original rotary engine several of the problems plaguing the design have been corrected. One such improvement is the apex seal which serves to reduce friction and fuel loss. Although several of the problems with the rotary engine have been corrected, significant ones still exist.

Historically, rotary engines have been plagued by several problems. Leakage under pressure has been an issue with designs since Ramelli first invented the rotary pump in 1588. Later internal combustion designs all had overheating as a common design fault. In the 1970's, General Motors abandoned an ambitious rotary engine project due to strict new environmental regulations on vehicle emissions. Additionally, rotary engines have had gas mileage far below the industry standard and are notorious for needing major engine seal repairs. Three main areas of concern are common to all rotary engine designs:

(a) Friction—because of their high rotational speed rotary engine designs create considerable centrifugal force resulting in friction.

(b) Sealing—chamber leakage under pressure wastes fuel and reduces engine efficiency.

(c) Durability—the two previous flaws add to the general wear and tear a combustion engine normally encounters to make durability a major concern.

Another problem specific to the technology presented herein is with vanes which serve to create separate chambers within an engine. Vanes are a common component in pumps and compressors but have not found success in combustion engines due to durability and sealing issues. Vanes can bend or even break under the high pressure and combustion they must endure in a combustion engine environment.

SUMMARY OF THE INVENTION

Accordingly, the previous disadvantages are remedied in our current invention. Several objectives and advantages of the invention are:

(a) to provide an engine with reduced engine friction;

(b) to provide an engine that is relatively easy to manufacture;

(c) to provide an engine that is comprised of few parts;

(d) to provide an engine that is smaller and more compact than existing designs;

(e) to provide an engine that conserves the fuel/air mixture.

Further objectives and advantages are to provide an engine that, because of the above listed objectives and advantages, will allow for superior gas mileage and performance.

DETAILED DESCRIPTION OF THE INVENTION

Example 1

Figure 2:
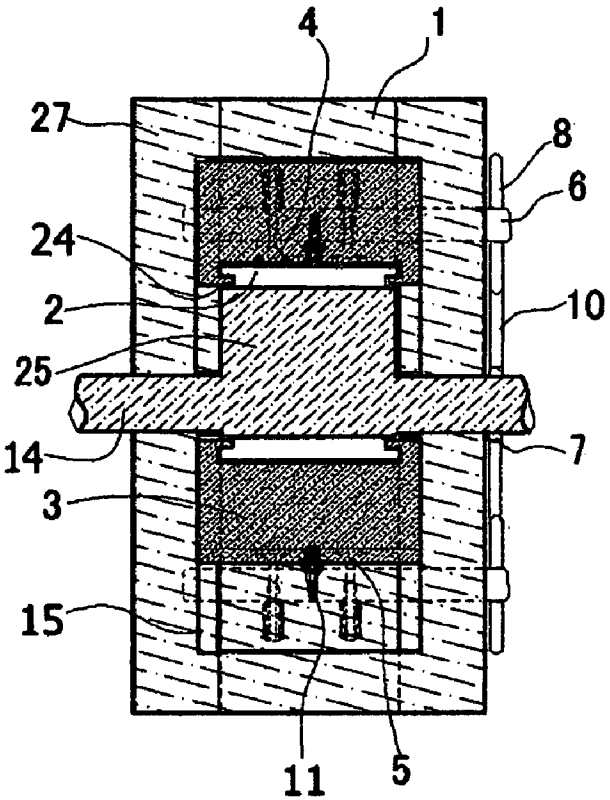
FIG. 2 shows a side view of the same four chamber design as depicted in FIG. 1 with vane channels on the interior surfaces of each end housing.
Figure 1:
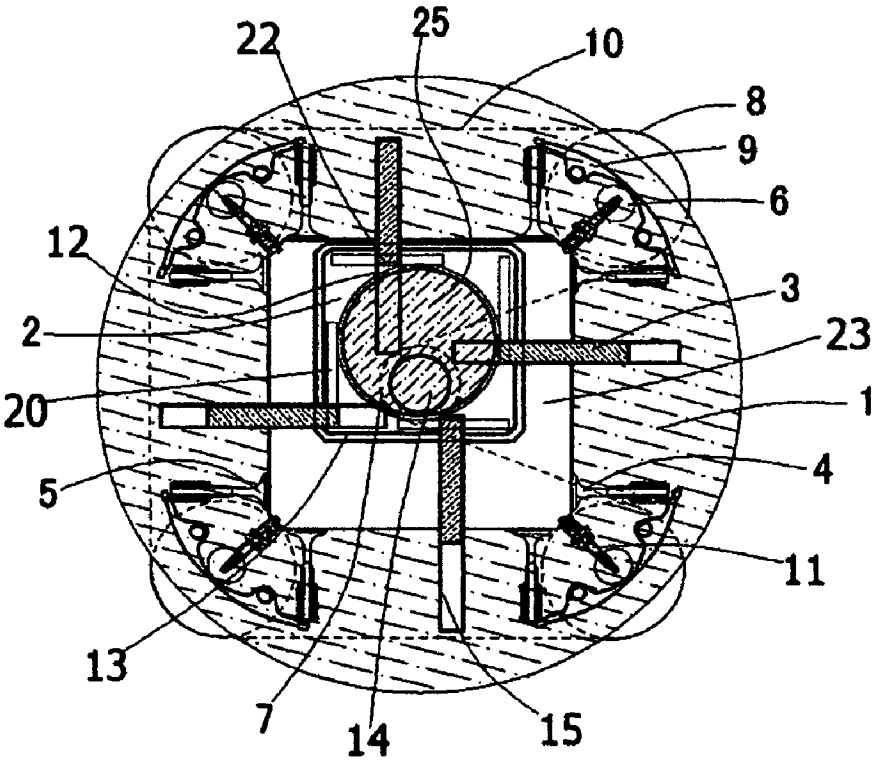
FIG. 1 shows an end view of an engine design with four chambers and incorporating an eccentric shaft. In this depiction, the rotor is in slideable contact with the vanes via the vane pins. This version incorporates a timing belt/chain to activate the valves.
Figure 3:
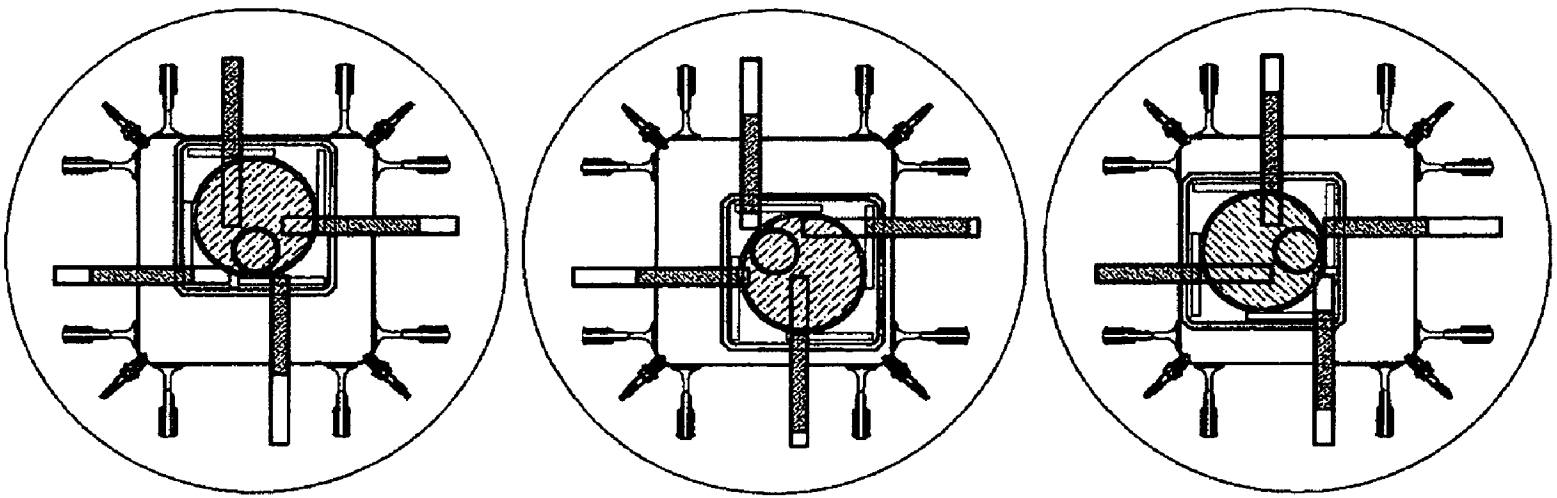
FIG. 3 depicts a side view the same four chamber engine as FIG. 1 as it orbits the driveshaft and displaces each chamber.
Figure 4:
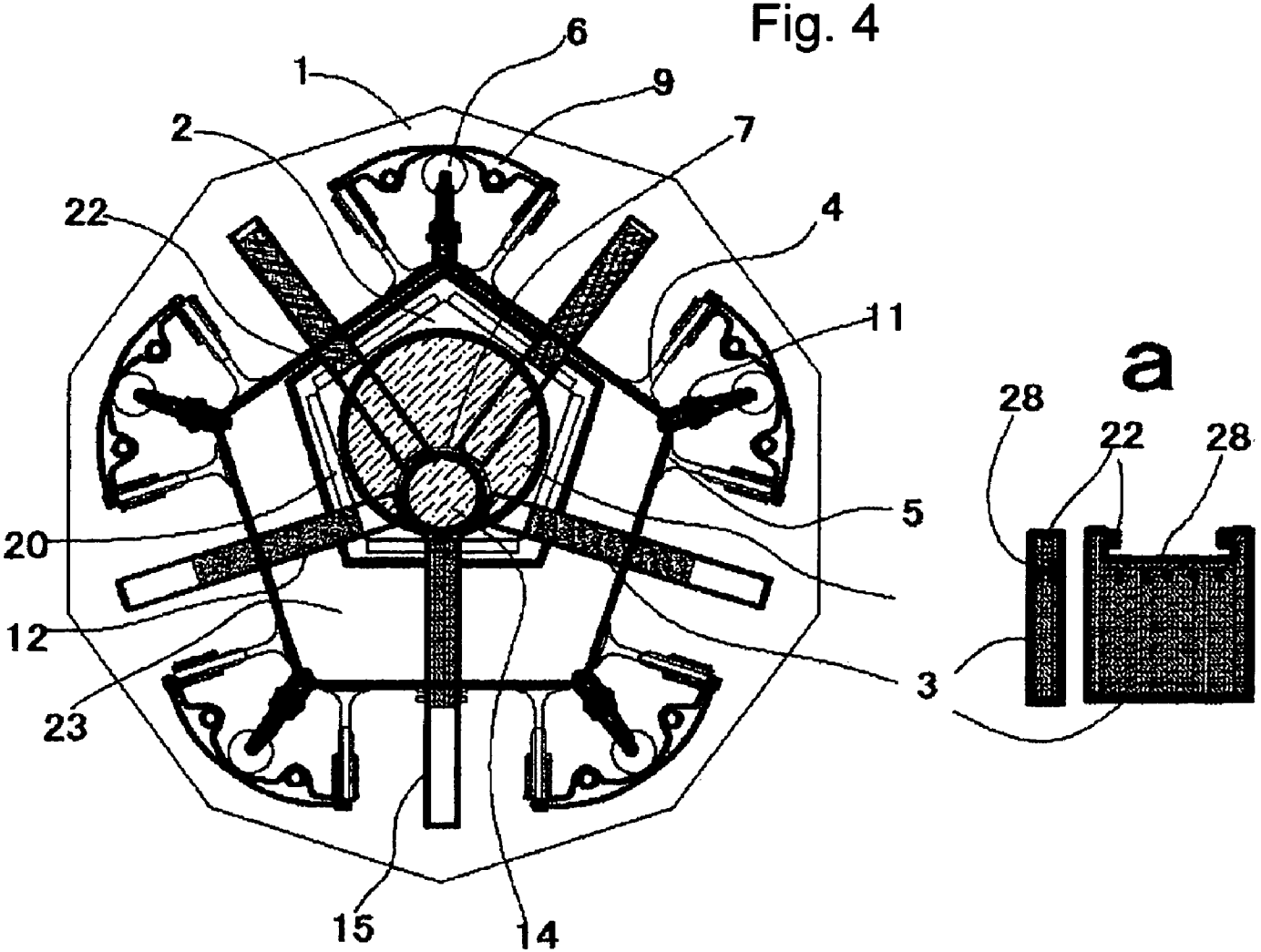
FIG. 4 shows an end view of a possible variation of the design FIG. 1 with five chambers and a front and end view of a vane.
Figure 5:
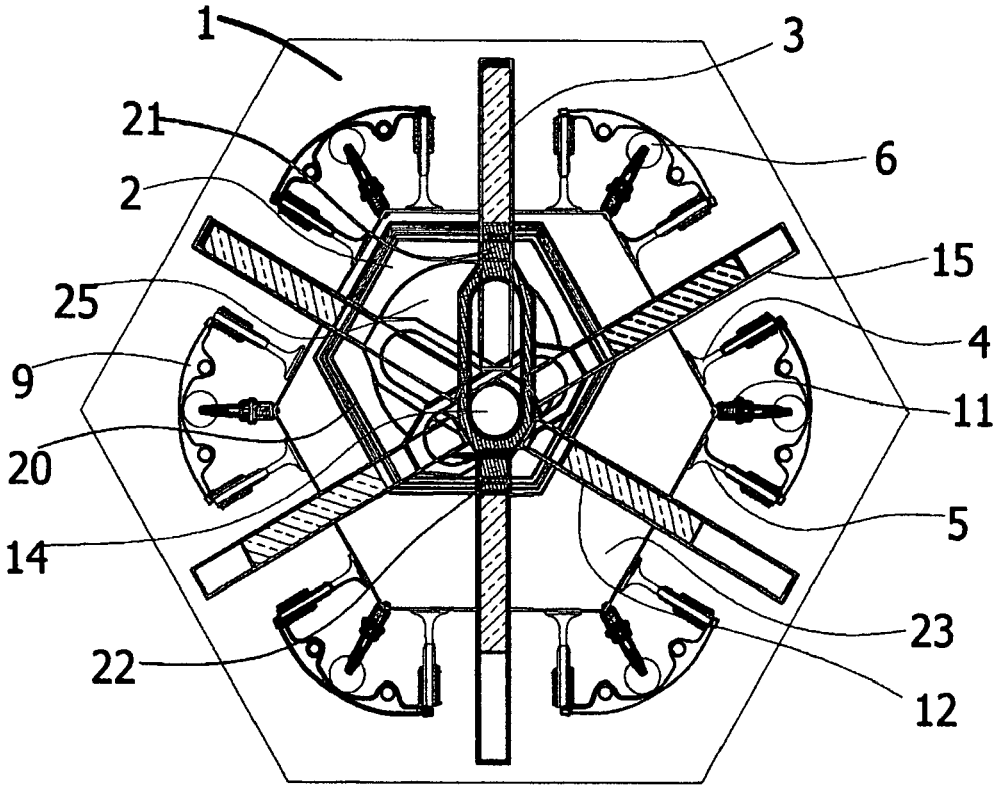
FIG. 5 shows an end view of a possible variation of the design in FIG. 1 with six chambers and vanes with wishbone supports.

An embodiment of the present invention is illustrated in FIG. 1. Additionally, FIGS. 4 and 5 depict possible embodiments with different shapes and numbers of working engine chambers.

The engine has housing (1), which in this a case has an inner wall which is a four sided polygon. Rotor (2), which in this case is also a four sided polygon, is contained inside housing (1) and is positioned off-center of drive shaft (14), allowing it to displace the fuel/air mixture about the engine chamber.

Vanes (3) extending between rotor (2) and the inner wall of housing (1) create separate chamber rooms (23) within the engine and are supported on each end by either rotor-side vane pins (22) or the vane recess (15) they slide in and out of in the side housing. Vane motion is restricted to rolling freely along, vane channels (12) located in the inner wall of each end housing. Vane pin slots (20) located around the periphery of rotor (2) allow the rotor to be in slideable contact with the vanes (3) via the vane pins (22) with the combination allowing both parallel movement and movement towards and away from the housing inner wall.

Fuel/air mixture enters each engine chamber (23) through intake valve (4). Valve springs apply constant pressure on each valve to keep it closed. The motion of rotor (2) then compresses the fuel/air mixture and combusts it using spark-plug (11) Expended gas is then purged through exhaust valve (5). Combustion causes rotor (2) to orbit the central axis of the inner Chamber of housing (1). This motion is converted to rotational energy with eccentric shaft (5), causing drive shaft (14) to rotate as the action is repeated in another chamber.

For every two rotations of rotor (2), the camshaft rotates once. As the camshaft rotates, it moves cam (6), which in turn acts to manipulate rocker arm (9). It is this manipulation of rocker arm (9) which causes intake valves (4) and exhaust valves (5) to open and close in each chamber room (23).

The opening and closing of the aforementioned valves replenishes the fuel/air mixture inside each separate chamber room (23). In this embodiment, the fuel/air mixture travels through an intake port and then travels through intake valve (4) and is drawn into the air-tight chamber room (23) created by rotor (2), vane (3), vane channel (12), vane recess (15) and the inner wall of housing (I). After combustion, the spent gas leaves the chamber through exhaust valve (5) into exhaust ports. From there the spent gas exits the engine.

Instead of using gears in this process, other possible variations of this design include using belts, chains, or nuts to rotate the camshaft and manipulate cam (6).

In this embodiment, any number of three or more vanes (3) can be incorporated to allow for any number of three or more chamber rooms (23). Any number of three or more intake valves (4) and exhaust valves (5) may also be used. To reduce friction, a ball bearing or similar system can easily be installed for the vanes (3). Furthermore, a crank and camshaft can accomplish the same vane (3) manipulation Given that the point where rotor (2) comes closet to the chamber wall in each combustion chamber represents 0 degrees, with spark plug (11) being located at 0 degrees, 180 degrees marks the point where rotor (2) is furthest from the inner wall of housing (1). From 0 degrees to 180 degrees, intake valve (4) is open. As intake valve (4) opens, the fuel air mixture enters the engine chamber.

From 180 degrees to 360 degrees, intake valve (4) is closed and no fuel air mixture enters engine chamber (23). At this time, the fuel air mixture in the chamber is compressed as rotor (2) moves toward the engine chamber wall. As rotor (7) nears a complete 360-degree cycle and the fuel air mixture is at its highest point of compression, spark plugs (11) ignite. This combustion causes a rapid increase in chamber pressure, causing rotor (2) to orbit the central axis of the housing inner chamber. This process occurs from 360 degrees to 540 degrees. After this point, exhaust valve (5) opens, and the spent gas is purged through the exhaust port. This purging process occurs from 540 degrees to 720 degrees, after which the four stroke cycle repeats.

Instead of using gears in this process, other possible variations of this design include using belts, chains, or nuts to rotate the camshaft and manipulate cam (6).

Given that the point where rotor (2) comes closet to the chamber wall in each combustion chamber represents 0 degrees, with spark plug (11) being located at 0 degrees, 180 degrees marks the point where rotor (2) is furthest from the inner wall of housing (1). From 0 degrees to 180 deuces, intake valve (4) is open. As intake valve (4) opens, the fuel air mixture enters the engine chamber.

From 180 degrees to 360 degrees, intake valve (4) is closed and no fuel air mixture enters engine chamber (23). At this time, the fuel air mixture in the chamber is compressed as rotor (2) moves toward the engine chamber wall. As rotor (2) nears a complete 360-degree cycle and the fuel air mixture is at its highest point of compression, spark plugs (11) ignite. This combustion causes a rapid increase in chamber pressure, causing rotor (2) to orbit the central axis of the housing inner chamber. This process occurs from 360 degrees to 540 degrees. After this point, exhaust valve (5) opens, and the spent gas is purged through the exhaust port. This purging process occurs from 540 degrees to 720 degrees, after which the four stroke cycle repeats.

Explanation of Four Engine Strokes:

Stroke one—Intake process 0-180 degrees

Stroke two—compression process 180-360 degrees=1 rotation

Stroke three—combustion process 360-540 degrees

Stroke four—purge process 340-720 degrees=2 rotations

This invention achieves the same results in two rotations as does a conventional four-stroke internal combustion piston engine.

Accordingly, the reader will see that the invention described here has numerous advantages over existing designs. This design will reduce friction with its orbit motion, improve sealing with its channeled vanes and will improve durability by decreasing the impact of the previous two factors on the internal combustion system. Additionally, the advantages described below will allow for superior gas mileage and performance in that this invention;

(a) reduces engine friction;

(b) is relatively easy to manufacture;

(c) is comprised of few parts;

(d) is smaller and more compact than existing designs;

(e) conserves the fuel/air mixture.

Although the description above contains many specifies, these should not be construed as limiting the scope of the invention but as merely providing illustrations of some of the presently preferred embodiments of the engine. For example, the engine can have any number of valves per chamber, a different shaped rotor, an inner-casing which does not have flat surfaces (such as slightly concave), etc.

Thus the scope of the invention should be determined by the appended claims and their legal equivalents, rather than by the examples given.

Example 2

An embodiment of the present invention is illustrated in FIG. 5.

The engine has housing (1), which in this case has an inner wall which is a six sided polygon. Rotor (2), which in this case is also a six sided polygon, is contained inside housing (1) and is positioned off-center of drive shaft (14), allowing it to displace the fuel/air mixture about the engine chamber. Other possible embodiments of this design include any rotor and housing inner surface combination with a polygon shape with an even number of sides.

Inside rotor (2) are vane pairs (3) which slide in and out of the rotor and housing (1) to create separate chamber rooms (23) within the engine. Dual vane support shaft (21) having a middle portion disposed about said drive shaft, allows vane pairs (3) movement relative to the drive shaft. Each of the aforementioned vane pairs (3) is supported by and is in slideable contact with vane recess (15) on each side of the housing inner wall allowing both parallel movement and movement towards and away from the housing inner wall. Vane motion is also restricted to by vane channels (12) located in the inner wall of each side housing.

Fuel/air mixture enters each engine chamber (23) through intake valve (4). Valve springs apply constant pressure on each valve to keep it closed. The motion of rotor (2) then compresses the fuel/air mixture and combusts it using spark-plug (11) Expanded gas is then purged through exhaust valve (5). Combustion causes rotor (2) to orbit the central axis of the inner chamber of housing (1). This motion is converted to rotational energy with eccentric shaft (5), causing drive shaft (14) to rotate as the action is repeated in another chamber.

For every two rotations of rotor (2), the camshaft rotates once. As the camshaft rotates, it moves can (6), which in turn acts to manipulate rocker arm (9). It is this manipulation of rocker arm (9) which causes intake valves (4) and exhaust to open and close in each chamber room (23).

The opening and closing of the aforementioned valves replenishes the fuel/air mixture inside each separate chamber room (23). In this embodiment, the fuel/air mixture travels through an intake port and then travels through intake valve (4) and is drawn into the air-tight chamber room (23) created by rotor (2), vane (3), vane channel (12), vane recess (15) and the inner wall of housing (1). After combustion, the spent gas leaves the chamber through exhaust valve (5) into exhaust ports. From there the spent exits the engine.

Instead of using gears in this process, other possible variations of this design include using belts, chains, or nuts to rotate the camshaft and manipulate cam (6).

In this embodiment, any number of two or more vanes (3) can be incorporated to allow for any number of four or more chamber rooms (23). Any number of four or more intake valves (4) and exhaust valves (5) may also be used. To reduce friction, a ball bearing or similar system can easily be installed for the vanes (3). Furthermore, a crank and camshaft can accomplish the same vane (3) manipulation Given that the point where rotor (2) comes closest to the chamber wall in each combustion chamber represents 0 degrees, with spark plug (11) being located at 0 degrees, 180 degrees marks the point where rotor (2) is furthest from the inner wall of housing (1). From 0 degrees to 180 degrees, intake valve (4) is open. As intake valve (4) opens, the fuel air mixture enters the engine, chamber.

From 180 degrees to 360 degrees, intake valve (4) is closed and no fuel air mixture enters engine chamber (23). At this time, the fuel air mixture in the chamber is compressed as rotor (2) moves toward the engine chamber wall. As rotor (2) nears a complete 360-degree cycle and the fuel air mixture is at its highest point of compression, spark plugs (11) ignite. This combustion causes a rapid increase in chamber pressure, causing rotor (2) to orbit the central axis of the housing inner chamber. This process occurs from 360 degrees to 540 degrees. After this point, exhaust valve (5) opens, and the spent gas is purged through the exhaust port. This purging process occurs from 540 degrees to 720 degrees, after which the four stroke cycle repeats.

Instead of using gears in this process, other possible variations of this design include using belts, chains, or nuts to rotate the camshaft and manipulate cam (6).

Given that the point where rotor (2) comes closet to the chamber wall in each combustion chamber represents 0 degrees, with spark plug (11) being located at 0 degrees, 180 degrees marks the point where rotor (7) is furthest from the inner wall of housing (1). From 0 degrees to 180 degrees, intake valve (4) is open. As intake valve (4) opens, the fuel air mixture enters the engine chamber.

From 180 degrees to 360 degrees, intake valve (4) is closed and no fuel air mixture engine chamber (23). At this time, the fuel it mixture in the chamber is compressed as rotor (2) moves toward the engine chamber wall. As rotor (2) nears a complete 360-degree cycle and the fuel air mixture is at its highest point of compression, spark plugs (11) ignite. This combustion causes a rapid increase in chamber pressure, causing rotor (2) to orbit the central axis of the housing inner chamber. This process occurs from 360 degrees to 540 degrees. After this point, exhaust valve (5) opens, and the spent gas is purged through the exhaust port. This purging process occurs from 540 degrees to 720 degrees, after which the four stroke cycle repeats.

Explanation of Four Engine Strokes:

Stroke one—Intake process 0-180 degrees

Stroke two—compression process 180-360 degrees=1 rotation

Stroke three—combustion process 360-540 degrees

Stroke four—purge process 540-720 degrees=2 rotations

This invention achieves the same results in two rotations as does a conventional four-stroke internal combustion piston engine.

Accordingly, the reader will see that the invention described here has numerous advantages over existing designs. This design will reduce friction with its orbit motion, improve sealing with its channeled vanes and will improve durability by decreasing the impact of the previous two factors on the internal combustion system. Additionally, the advantages described below will allow for superior as mileage and performance in that invention:

(a) reduces engine friction;

(b) is relatively easy to manufacture;

(c) is comprised of few parts;

(d) is smaller and more compact than existing designs;

(e) conserves the fuel/air mixture.

Although the description above contains many specifics, these should not be construed as limiting the scope of the invention but as merely providing illustrations of some of the presently preferred embodiments of the engine. For example, the engine can have any number of valves per chamber, a different shaped rotor, an inner-casing which docs not have flat surfaces (such as slightly concave), etc.

Thus the scope of the invention should be determined by the appended claims and their legal equivalents, rather than by the example given.

Example 3

Figure 6:
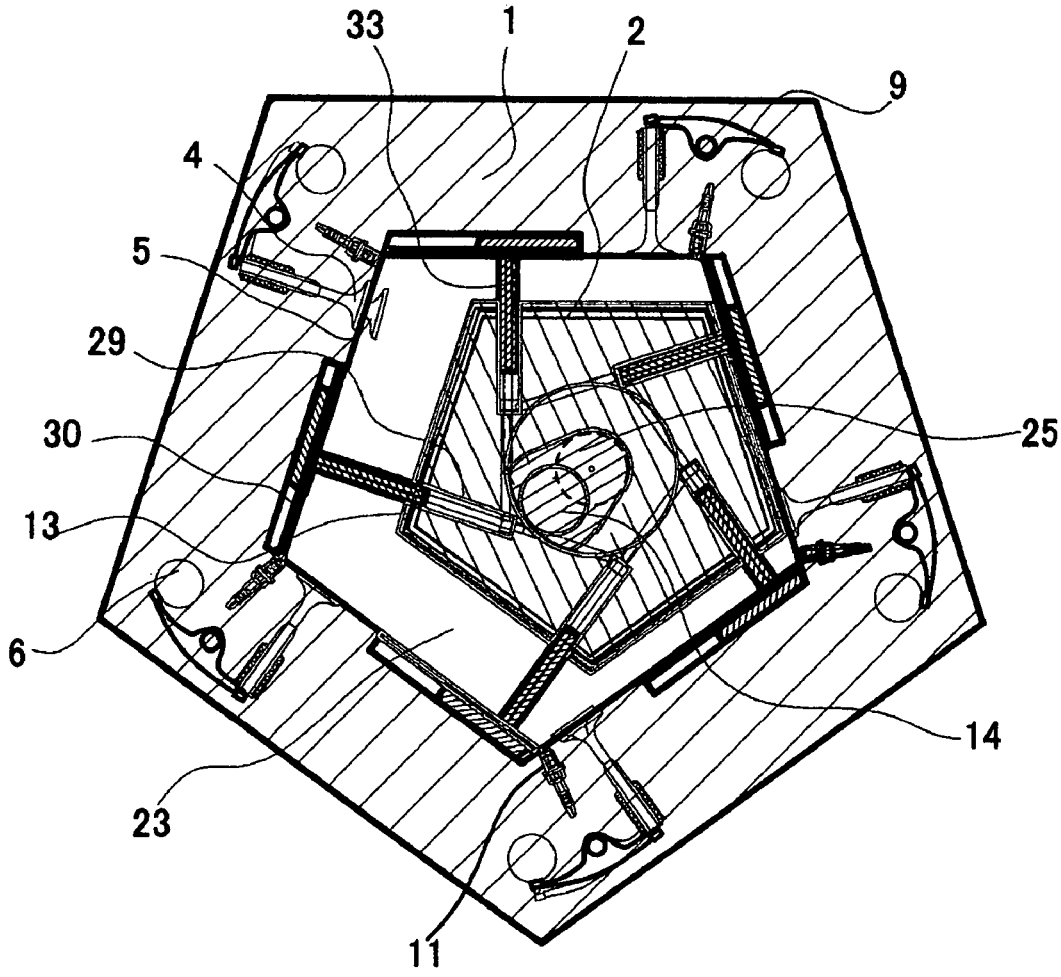
FIG. 6 shows an end view of a live chamber engine design with "T" or "L" shaped vanes. In this depiction vanes slide in and out of recesses in the rotor and also travel along channels on the interior surface of the side housing.
Figure 7:
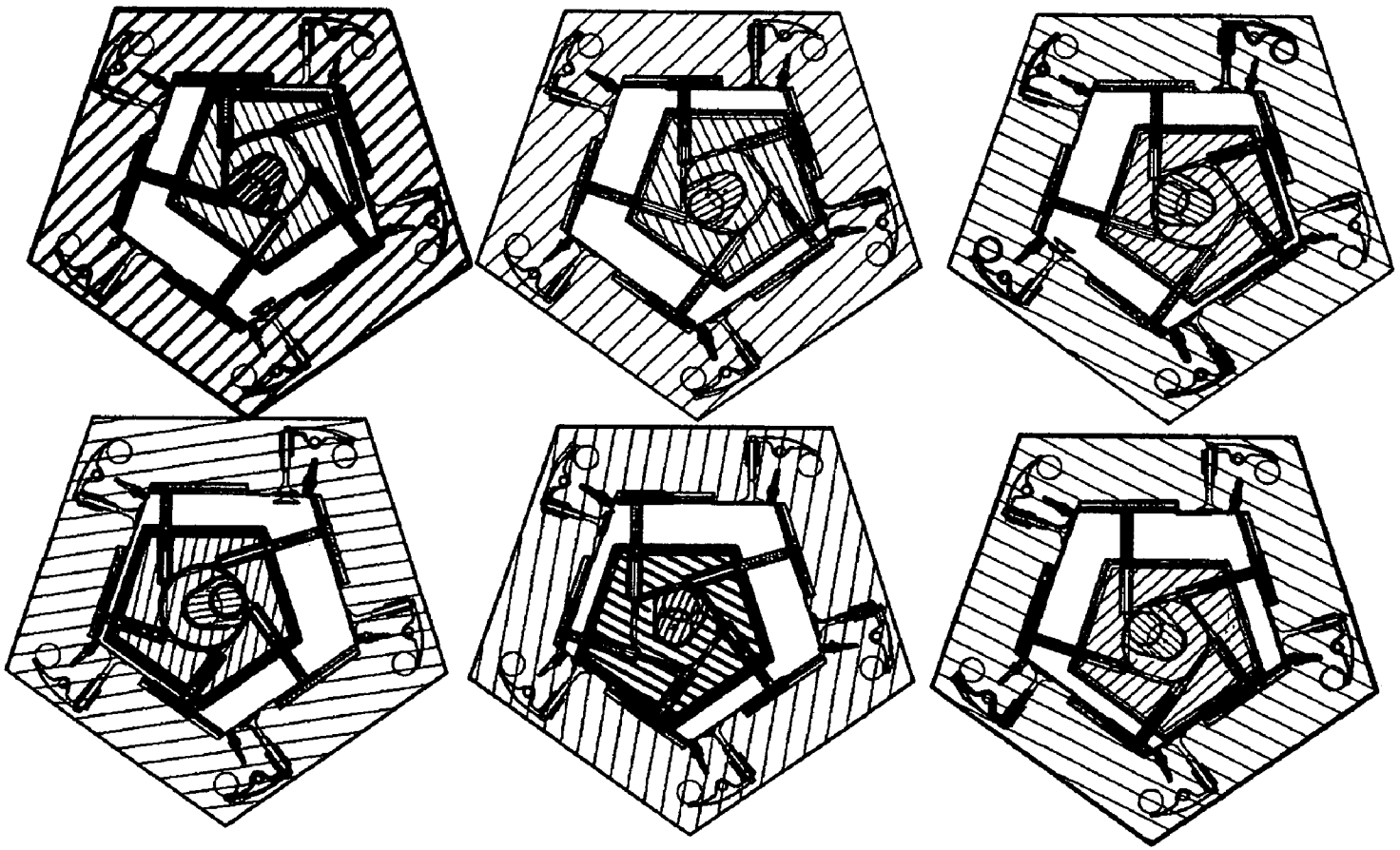
FIG. 7 depicts an end view the same five chamber engine as FIG. 6 as it orbits the driveshaft and displaces each chamber.
Figure 8:
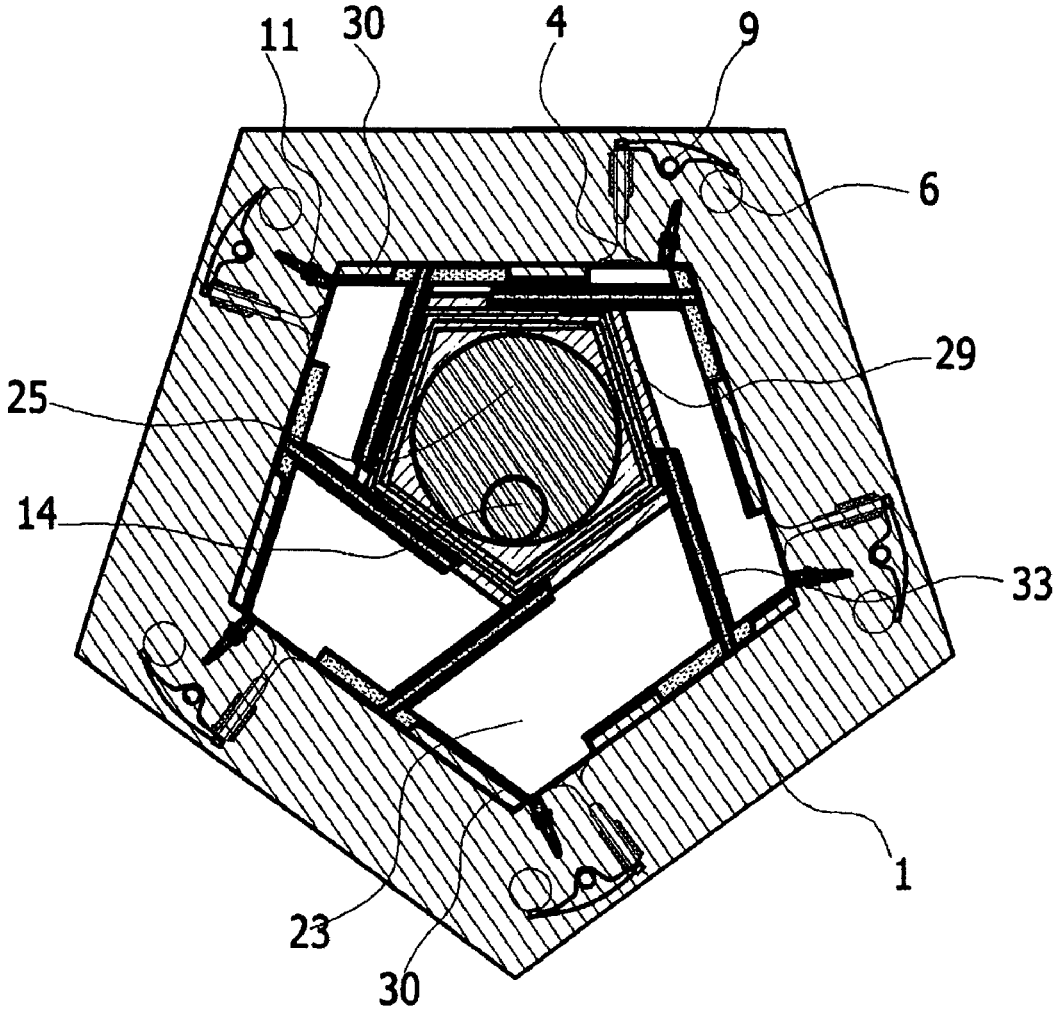
FIG. 8 shows an end view of a possible variation of the design in FIG. 6 with five chambers and "T" or "L" shaped which move in and out of recesses on the periphery of the rotor.
Figure 9:
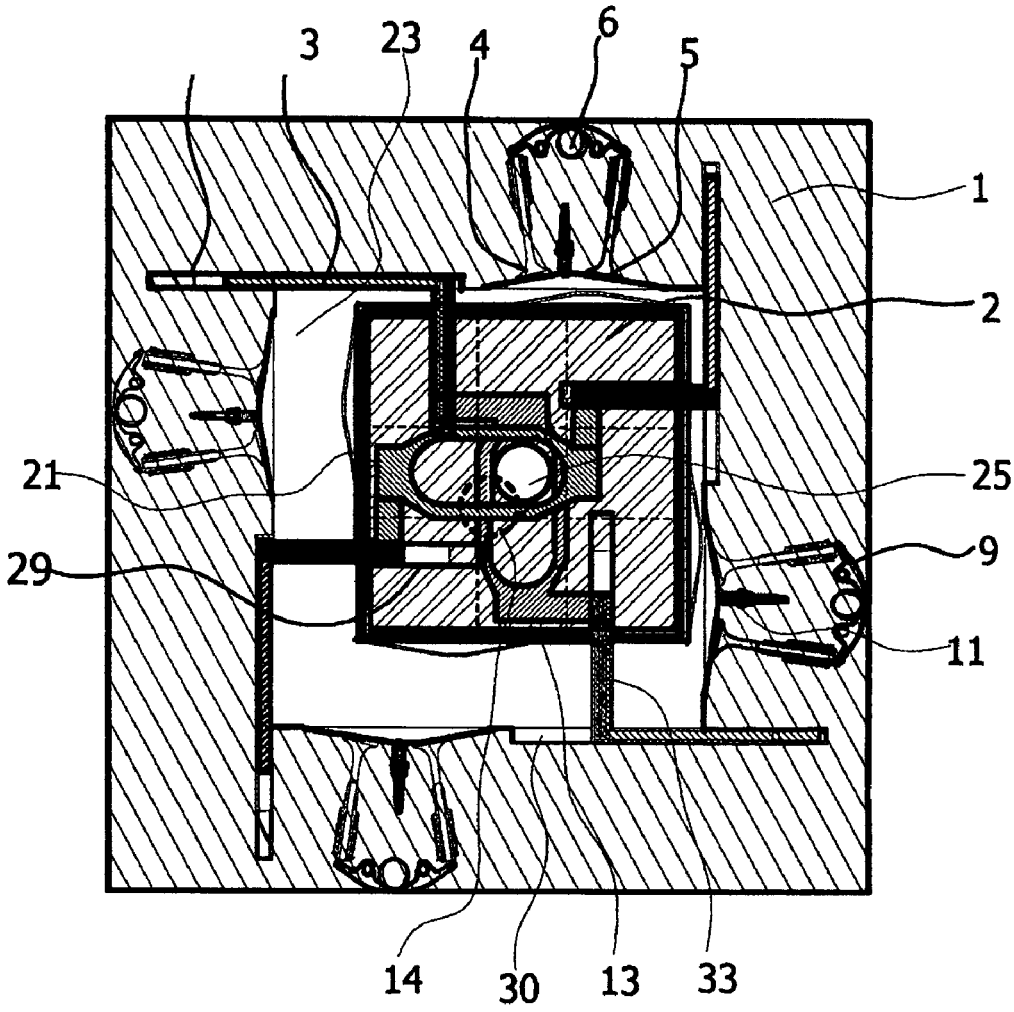
FIG. 9 shows an end view of a possible variation of the design in FIG. 6 with four chambers and vanes with wishbone supports.

An embodiment of the present invention is illustrated in FIG. 6. Additionally, FIGS. 7, 8 and 9 depict possible embodiments with different shapes, configurations and numbers of working engine chambers.

The engine has housing (1), which in this case has an inner wall which is a five sided polygon. Rotor (2), which in this case is also a five sided polygon, is contained inside housing (1) and is positioned off-center of drive shaft (14), allowing it to displace the fuel/air mixture about the engine chamber.

Vanes (33) extending between rotor (2) and the inner wall of housing (1) create separate chamber rooms (23) within the engine and are supported on each end by either vane guide (30) or vane recess (29). In this depiction, vanes (33) slide in and out of rotor (2) through vane recess (29) and are in slidable contact with the housing through vane guides (30) located around the periphery of the rotor. This combination of vane recesses and vane guides allows the rotor both parallel movement and movement towards and away from the housing inner wall. Other possible embodiments of this design include any rotor and housing inner surface combination with a polygon shape. Additionally, the combination of vane recesses and vane guides can be reversed with vane recesses being located in the housing and vane guides being located along the periphery of the rotor. Fuel/air mixture enters each engine chamber (23) through intake valve (4). Valve springs apply constant pressure on each valve to keep it closed. The motion of rotor (2) then compresses the fuel/air mixture and combusts it using sparkplug (11) Expended gas is then purged through exhaust valve (5). Combustion causes rotor (2) to orbit the central axis of the inner chamber of housing (1). This motion is converted to rotational energy with eccentric shaft (5), causing drive shaft (14) to rotate as the action is repeated in another chamber.

For every two rotations of rotor (2), the camshaft rotates once. As the camshaft rotates, it moves cam (6), which in turn acts to manipulate rocker arm (9). It is this manipulation of rocker arm (9) which causes intake valves (4) and exhaust valves (5) to open and close in each chamber room (23).

The opening and closing of the aforementioned valves replenishes the fuel/air mixture inside each separate chamber room (23). In this embodiment, the fuel/air mixture travels through an intake port and the travels through intake valve (4) and is drawn into the air-tight chamber room (23) created by rotor (2), vane (33), vane recess (29), vane guide (30) and the inner wall of housing (1). After combustion, the spent gas leaves the chamber through exhaust valve (5) into exhaust ports. From there the spent gas exits the engine.

Instead of using gears in this process, other possible variations of this design include using belts, chains, or nuts to rotate the camshaft and manipulate cam (6).

In this embodiment, any number of three or more vanes (33) can be incorporated to allow for any number of three or more chamber rooms (23). Any number of three or more intake valves (4) and exhaust valves (5) may also be used. To reduce friction, a ball bearing or similar system can easily be installed for the vanes (33). Furthermore, a crank and camshaft can accomplish the same vane (3) manipulation Given that the point where rotor (2) comes closest to the chamber wall in each combustion chamber represents 0 degrees, with spark plug (11) being located at 0 degrees, 180 degrees marks the point where rotor (2) is furthest from the inner wall of housing (1). From 0 degrees to 180 degrees, intake valve (4) is open. As intake valve (4) opens, the fuel air mixture enters the engine chamber.

From 180 degrees to 360 degrees, intake valve (4) is closed and no fuel air mixture enters engine chamber (23). At this time, the fuel air mixture in the chamber is compressed as rotor (2) moves toward the engine chamber wall. As rotor (2) nears a complete 360-degree cycle and the fuel air mixture is at its highest point of compression, spark plugs (11) ignite. This combustion causes a rapid increase in chamber pressure, causing rotor to orbit the central axis of the housing inner chamber. This process occurs from 360 degrees to 540 degrees. After this point, exhaust valve (5) opens, and the spent gas is purged through the exhaust port. This purging process occurs from 540 degrees to 720 degrees, after which the four stroke cycle repeats.

Instead of using gears in this process, other possible variations of this design include using belts, chains, or nuts to rotate the camshaft and manipulate cam (6).

Given that the point where rotor (2) comes closest to the chamber wall in each combustion chamber represents 0 degrees, with spark plug (11) being located at 0 degrees, 180 degrees marks the point where rotor (2) is farthest from the inner wall of housing (1). From 0 degrees to 180 degrees, intake valve (4) is open. As intake valve (4) opens, the fuel air mixture enters the engine chamber.

From 180 degrees to 360 degrees, intake valve (4) is closed and no fuel air mixture enters engine chamber (23). At this time, the fuel air mixture in the chamber is compressed as rotor (2) moves toward the engine chamber wall. As rotor (2) nears a complete 360-degree cycle and the fuel air mixture is at its highest point of compression, spark plugs (11) ignite. This combustion causes a rapid increase in chamber pressure, causing rotor (2) to orbit the central axis of the housing inner chamber. This process occurs from 360 degrees to 540 degrees. After this point, exhaust valve (5) opens, and the spent gas is purged through the exhaust port. This purging process occurs from 540 degrees to 720 degrees, after which the four stroke cycle repeats.

Explanation of Four Engine Strokes:

Stroke one—Intake process 0-180 degrees

Stroke two—compression process 180-360 degrees=1 rotation

Stroke three—combustion process 360-540 degrees

Stroke four—purge process 540-720 degrees=2 rotations

This invention achieves the same results in two rotations as does a conventional four-stroke internal combustion piston engine.

Accordingly, the reader will see that the invention described here has numerous advantages over existing designs. This design will reduce friction with its orbit motion, improve scaling with its channeled vanes and will improve durability by decreasing the impact of the previous two factors on the internal combustion system. Additionally, the advantages described below will allow for superior gas mileage and performance in that this invention;

(a) reduces engine friction;

(b) is relatively easy to manufacture;

(c) is comprised of few parts;

(d) is smaller and more compact than existing designs;

(c) conserves the fuel/air mixture.

Although the description above contains many specifics, these should not be construed as limiting the scope of the invention but as merely providing illustrations of some of the presently preferred embodiments of the engine. For example, the engine can have any number of valves per chamber, a different shaped rotor, an inner-casing which does not have flat surfaces (such as slightly concave) etc.

Thus the scope of the invention should be determined by the appended claims and their legal equivalents, rather than by the examples given.

Example 4

Figure 10:
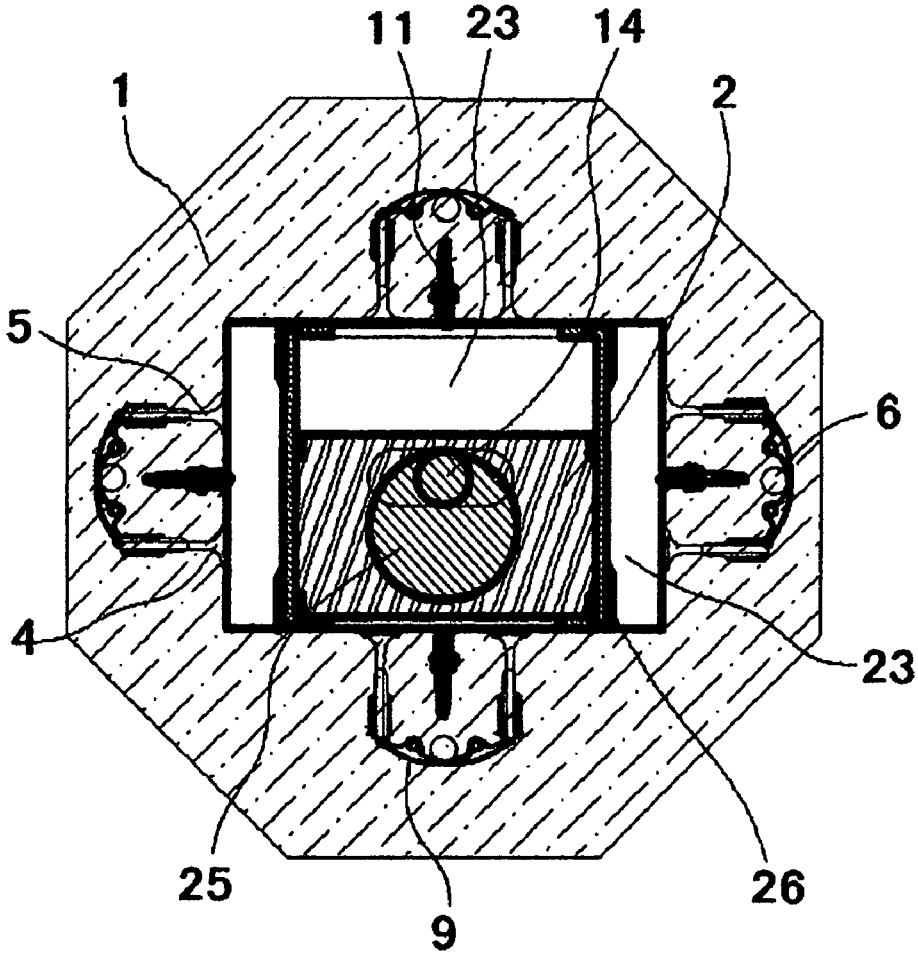
FIG. 10 shows an end view of a four chamber engine with an outer and an inner rotor.
Figure 11:
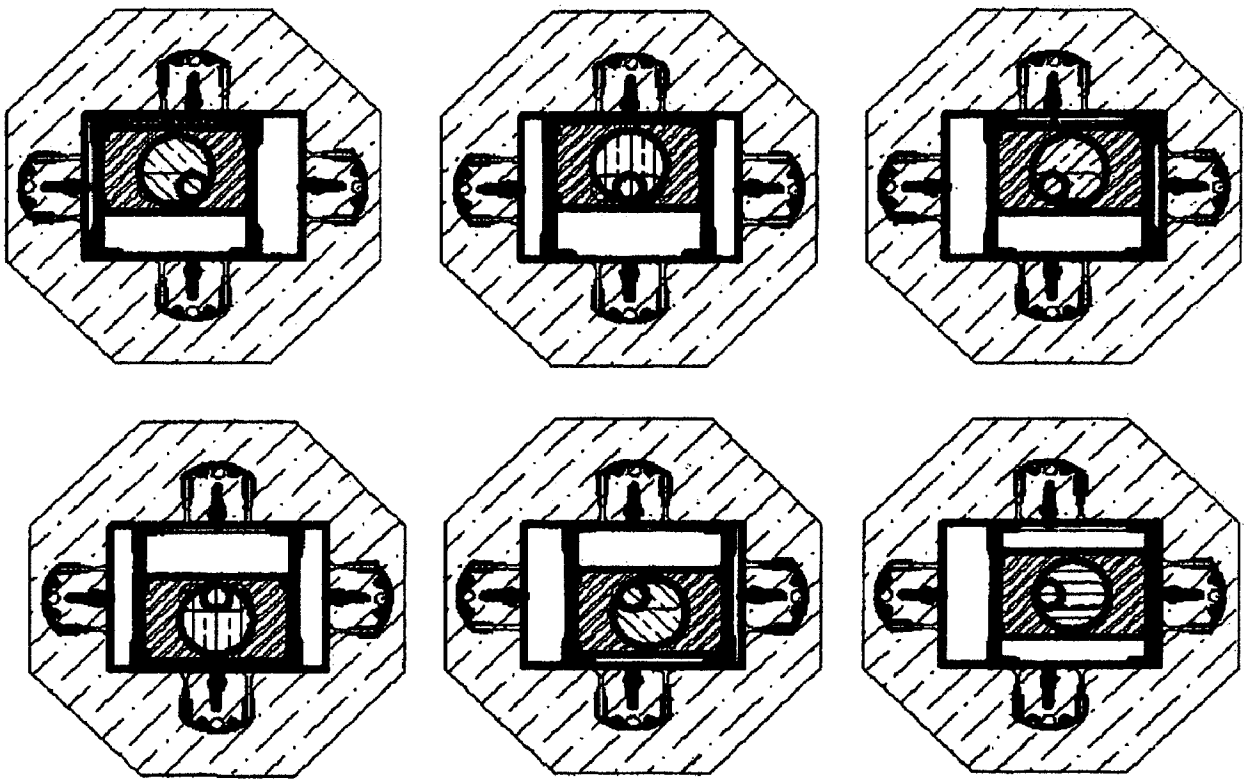
FIG. 11 depicts a side view the same four chamber engine as FIG. 10 as it orbits the driveshaft and displaces each chamber.

An embodiment of the present invention is illustrated in FIG. 10.

The engine has housing (1), which in this case has an inner wall which is a four sided polygon. Outer rotor (26), which in this case is also a four sided polygon, is contained inside housing (1) and is positioned off-center of drive shaft (14). Orbit motion allows outer rotor (26), to displace the fuel/air mixture about the engine chamber as it moves towards and away from the housing inner wall and creates two separate chambers within the housing. Rotor (2) is contained inside outer rotor (26) and is also is positioned off-center of drive shaft (14). Orbit motion allows rotor, to displace the furl/air mixture about the engine chamber as it moves towards and away from the housing inner wall and creates two separate chambers within the housing to make a total of four engine chambers.

Fuel/air mixture enters each engine chamber (23) through intake valve (4). Valve springs apply constant pressure on each valve to keep it closed. The motion of outer rotor (26) or rotor (2) then compresses the fuel/air mixture and combusts it using sparkplug (11) Expended gas is then purged through exhaust valve (5). Combustion causes outer rotor (26) and rotor (2) to orbit the central axis of the inner chamber of housing (1). This motion is converted to rotational energy with eccentric shaft (5), causing drive shaft (14) to rotate as the action is repeated in another chamber.

For every two rotations of rotor (2), the camshaft rotates once. As the camshaft rotates, it moves cam (6), which in turn acts to manipulate rocker arm (9). It is this manipulation of rocker arm (9) which causes intake valves (4) and exhaust valves (5) to open and close in each chamber room (23).

The opening and closing of the aforementioned valves replenishes the fuel/air mixture inside each separate chamber room (23). In this embodiment, the fuel/air mixture travels through an intake port and then travels through intake valve (4) and is drawn into the air-tight chamber room (23) created by outer rotor (26) and rotor (2) and the inner will of housing (1). After combustion, the spent gas leaves the chamber through exhaust valve (5) into exhaust ports. From there the spent gas exits the engine. Instead of using gears in this process, other possible variations of this design include using belts, chains, or nuts to rotate the camshaft and manipulate cam (6).

Given that the point where rotor (2) comes closest to the chamber wall in each combustion chamber represents 0 degrees with spark plug (11) being located at 0 degrees, 180 degrees marks the point where rotor (2) is furthest from the inner wall of housing (1). From 0 degrees to 180 degrees, intake valve (4) is open. As intake valve (4) opens, the fuel air mixture enters the engine chamber.

From 180 degrees to 360 degrees, intake valve (4) is closed and no fuel air mixture enters engine chamber (23). At this time, the fuel air mixture in the chamber is compressed as rotor (2) moves toward the engine chamber wall. As rotor (2) nears a complete 360-degree cycle and the fuel air mixture is at its highest point of compression, spark plugs (11) ignite. This combustion causes a rapid increase in chamber pressure, causing rotor (2) to orbit the central axis of the housing inner chamber. This process occurs from 360 degrees to 540 degrees. After this point, exhaust valve (5) opens, and the spent gas is purged through the exhaust port. This purging process occurs from 540 degrees to 720 degrees, after which the our stroke cycle repeats.

Explanation of Four Engine Strokes:

Stroke one—intake process 0-180 degrees

Stroke two—compression process 180-160 degrees=1 rotation

Stroke three—combustion process 160-540 degrees

Stroke four—purge process 540-720 degrees=2 rotations

This invention achieves the same results in two rotations as does a conventional four-stroke internal combustion piston engine.

Accordingly, the reader will see that the invention described here has numerous advantages over existing designs. This design will reduce friction with its orbit motion, improve sealing with its channeled vanes and will improve durability by decreasing the impact of the previous two factors on the internal combustion system. Additionally, the advantages described below will allow for superior gas mileage and performance in that this invention:

(a) reduces engine friction;

(b) is relatively easy to manufacture;

(c) is comprised of few parts;

(d) is smaller and more compact than existing designs;

(e) conserves the fuel/air mixture.

Although the description above contains many specifies, these should not construed as limiting the scone of the invention but as merely providing illustrations of some of the presently preferred embodiments of the engine. For example, the engine can have any number of valves per chamber, a different shaped rotor, an inner-casing which does not have flat surfaces (such as slightly concave), etc.

Thus the scope of the invention should be determined by the appended claims and their legal equivalents, rather than by the examples given. cl PARTS LIST

1) Housing
2) Rotor
3) Vane
4) intake valve
5) Exhaust valve
6) Cam
7) Drive shaft timing gear
8) Cam timing gear
9) Rocker arm
10) Timing belt
11) Spark plug
12) Vane channel
13) Rotor seal
14) Drive shaft
15) Vane recess
16) Unused
17) Unused
18) Unused
19) Inner rotor
20) Vane pin slot
21) Dual vane support shaft
22) Vane pin
23) Engine chamber
24) Vane seal
25) Eccentric shaft or crank shaft
26) Outer rotor
27) End housing
28) Vane seal
29) Vane recess
30) Vane guide
33) "T" or "L" shaped vane

What is claimed is:

1. A rotary internal combustion engine comprising:

a housing means defining a combustion chamber having a polygonal shaped inner surface and ends and a central axis passing there-through, a driveshaft means rotationally mounted in the housing means, a polygonal shaped rotor including surfaces and positioned off-center of the central chamber axis, a plurality of vanes disposed about said rotor creating at least three sections of said combustion chamber within the engine, wherein each of said surfaces of said polygonal shaped rotor are in contact with each of said three sections of said combustion chamber, and wherein said polygonal shaped rotor operates in four Otto cycles relative to each of said at least three sections of said combustion chamber, an eccentric member secured to said driveshaft means for converting orbit motion of said rotor into shaft rotational energy, vane pins positioned around a peripheral of said polygonal shaped rotor and allowing said vanes to be in slidable contact with the polygonal shaped rotor, vane channels disposed about the inner surface of the ends of the housing means to restrict the movement of said vanes, vane recesses disposed about the inner surface of the housing means allow said vanes to move in and out of the housing means, means for providing a combustible air and fuel mixture to each of said at least three sections of said combustion chamber, at least one set of intake and exhaust valve means, wherein said at least one set of intake and exhaust valve means is positioned in communication with each of said at least three sections of said combustion chamber mounted on the housing means for controlling the flow of said air and fuel mixture into and out of said at least three sections of said combustion chamber, wherein said vanes are located between said at least one set of said intake and exhaust valve means in said combustion chamber, means for operating said at least one set of said intake and exhaust valve means in timed relation with the orbit motion of said polygonal shaped rotor to allow said air and fuel mixture to flow into each of said at least three sections of said combustion chamber and allow exhaust gases to flow out of each of said at least three sections of said combustion chamber, and a fuel ignition means in communication with each of said at least three sections of said combustion chamber operable to ignite the fuel in said combustion chamber to thereby cause said rotor to have orbital movement and rotate the driveshaft means.

2. The engine according to claim 1, wherein said vanes include a plurality of vane pairs, wherein said vane pairs are movable relative to the drive shaft means and have a middle portion disposed about said drive shaft means, and wherein said vane pairs further include two exterior vane portions substantially disposed along a diameter of said polygonal shaped rotor.

3. A rotary internal combustion engine comprising:

a housing means defining a chamber having a polygonal shaped inner surface and ends and a central axis passing there-through, a driveshaft means rotationally mounted in the housing means, a polygonal shaped rotor including surfaces and positioned off-center of the central chamber axis, a plurality of vanes being at least "T" shaped vanes and "L" shaped vanes, which are disposed about said rotor creating at least three sections of said combustion chamber within the engine, wherein each of said surfaces of said a polygonal shaped rotor is in contact with each of said at least three sections of said combustion chamber, and wherein said polygonal shaped rotor operates in four Otto cycles relative to each of said at least three sections of said combustion chamber, an eccentric member secured to said driveshaft means for converting orbit motion of said rotor into shaft rotational energy, vane guides disposed about the inner surface of the housing means to restrict the slideable movement of said at least "T" shaped vanes and "L" shaped vanes within thereof, vane recesses disposed within the rotor allow said at least "T" shaped vanes and "L" shaped vanes to move in and out of said polygonal shaped rotor, a means for providing a combustible air and fuel mixture to each of said at least three sections of said combustion chamber, at least one set of intake and exhaust valve means, wherein said at least one set of intake and exhaust valve means is positioned in communication with each of said at least three sections of said combustion chamber mounted on the housing means for controlling the flow of said air and fuel mixture into and out of said at least three sections of said combustion chamber, wherein said vanes are located between said at least one set of intake and exhaust valve means in said combustion chamber, means for operating said at least one set of said intake and exhaust valve means in timed relation with the orbit motion of said polygonal shaped rotor to allow said air and fuel mixture to flow into said at least three sections of said combustion chamber and allow exhaust gases to flow out of said at least three sections of said combustion chamber, and a fuel ignition means in communication with each of said at least three sections of said combustion chamber operable to ignite the fuel in said combustion chamber to thereby cause said polygonal shaped rotor to have orbital movement and rotate the driveshaft means.

4. The engine according to claim 3, wherein said vane guides are disposed within said polygonal shaped rotor and restrict the movement of said vanes, and wherein said vane recesses disposed within said housing inner surface allow said vanes to move in and out of the housing means.

5. The engine according to claim 3 or 4, wherein said vanes include a plurality of vane pairs, wherein said vane pairs are movable relative to the drive shaft and have a middle portion disposed about said drive shaft, and wherein said vane pairs further include two exterior vane portions substantially disposed along a diameter of said polygonal shaped rotor.

6. A rotary internal combustion engine comprising:

a housing means defining a chamber having a four-sided polygonal shaped inner surface and ends and a central axis passing there-through, a driveshaft means rotationally mounted in the housing means, a four-sided polygonal shaped outer rotor positioned off-center of the central chamber axis creating separate combustion chambers within the engine, a four-sided polygonal shaped inner rotor positioned off-center of the central chamber axis creating separate combustion chambers within the engine, an eccentric member secured to said driveshaft means for converting orbit motion of said four-sided polygonal outer and inner rotors into shaft rotational energy, wherein said four-sided polygonal outer and inner rotors having surfaces are in contact with each of said combustion chambers and movable in four Otto cycles relative to said each of said combustion chambers, means for providing a combustible air and fuel mixture to each of said at least three sections of said combustion chamber, at least one set of intake and exhaust valve means, wherein said at least one set of intake and exhaust valve means is positioned in communication with each of said at least three sections of said combustion chamber mounted on the housing means for controlling the flow of said air and fuel mixture into and out of said at least three sections of said combustion chamber, wherein said vanes are located between said at least one set of intake and exhaust valve means in said combustion chamber, means for operating said at least one set of said intake and exhaust valve means in timed relation with the orbit motion of said four-sided polygonal inner rotor to allow said air and fuel mixture to flow into each of said combustion chambers and allow exhaust gases to flow out of each of said combustion chambers, a fuel ignition means in communication with each of said combustion chambers operable to ignite the fuel in each of said combustion chambers to thereby cause said four-sided polygonal outer and inner rotors to have orbital movement and rotate the driveshaft means.

* * * * *